US008511906B2

(12) United States Patent
Marchand

(10) Patent No.: US 8,511,906 B2
(45) Date of Patent: Aug. 20, 2013

(54) OIL-SEALED MUD MOTOR BEARING ASSEMBLY WITH MUD-LUBRICATED OFF-BOTTOM THRUST BEARING

(75) Inventor: Nicholas Marchand, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 151 days.

(21) Appl. No.: 13/014,819

(22) Filed: Jan. 27, 2011

(65) Prior Publication Data

US 2012/0195542 A1 Aug. 2, 2012

(51) Int. Cl.

| | |
|---|---|
| ***F16C 19/10*** | (2006.01) |
| ***F16C 19/00*** | (2006.01) |
| ***F16C 3/00*** | (2006.01) |
| ***F16N 1/00*** | (2006.01) |

(52) U.S. Cl.
USPC ..... 384/606; 384/97; 384/613; 384/368

(58) Field of Classification Search
USPC ..... 384/95–97, 121, 123, 452–455, 93, 384/322, 368, 397, 415, 606, 607; 175/107, 175/195
See application file for complete search history.

(56) References Cited

U.S. PATENT DOCUMENTS

| | | | | | |
|---|---|---|---|---|---|
| 2,963,099 | A | * | 12/1960 | Gianelloni, Jr. | 175/25 |
| 3,194,325 | A | * | 7/1965 | Gianelloni, Jr. | 175/26 |
| 3,456,746 | A | * | 7/1969 | Tschirky et al. | 175/320 |
| 3,844,729 | A | * | 10/1974 | Sedlatschek et al. | 428/560 |
| 3,982,859 | A | * | 9/1976 | Tschirky et al. | 418/48 |
| 4,361,194 | A | * | 11/1982 | Chow et al. | 175/107 |
| 4,372,400 | A | | 2/1983 | Beimgraben | |
| 4,546,836 | A | * | 10/1985 | Dennis et al. | 175/107 |
| 4,729,440 | A | * | 3/1988 | Hall | 175/107 |
| 4,732,491 | A | * | 3/1988 | Geczy | 384/95 |
| 5,253,939 | A | * | 10/1993 | Hall | 384/303 |
| 5,498,081 | A | * | 3/1996 | Dennis et al. | 384/95 |
| 2003/0015352 | A1 | * | 1/2003 | Robin | 175/107 |
| 2003/0111269 | A1 | * | 6/2003 | Blair et al. | 175/101 |
| 2007/0071373 | A1 | * | 3/2007 | Wenzel | 384/97 |

OTHER PUBLICATIONS

PCT/US2012/022700 International Search Report and Written Opinion dated Dec. 18, 2012 (11 p.).

* cited by examiner

*Primary Examiner* — Alan Waits
(74) *Attorney, Agent, or Firm* — Conley Rose, P.C.

(57) ABSTRACT

A bearing assembly for a mud motor has a mandrel rotatably disposed within a cylindrical housing, with a rolling-element thrust bearing disposed within an oil-sealed annular chamber between the mandrel and the housing, for resisting on-bottom axial thrust loads. Off-bottom axial thrust loads are resisted by a mud-lubricated thrust bearing assembly located above the oil-sealed chamber. The lower end of a drive shaft adapter coupled to the mandrel is used to provide an upper load-transferring shoulder for the off-bottom thrust bearing, with a lower load-transferring shoulder being provided in association with the housing. The upper and lower shoulders come into mating contact under off-bottom thrust loading, with the upper shoulder rotatable (with the mandrel) relative to the lower shoulder.

12 Claims, 3 Drawing Sheets

OIL-SEALED MUD MOTOR BEARING ASSEMBLY WITH MUD-LUBRICATED OFF-BOTTOM THRUST BEARING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The invention relates generally to bearing assemblies for mud motors used in drilling of oil, gas, and water wells. More particularly, the invention relates to mud motor bearings for resisting on-bottom and off-bottom thrust loads.

2. Background of the Technology

In drilling a wellbore into the earth, such as for the recovery of hydrocarbons or minerals from a subsurface formation, it is conventional practice to connect a drill bit onto the lower end of an assembly of drill pipe sections connected end-to-end (commonly referred to as a "drill string"), and then rotate the drill string so that the drill bit progresses downward into the earth to create the desired wellbore. In conventional vertical wellbore drilling operations, the drill string and bit are rotated by means of either a "rotary table" or a "top drive" associated with a drilling rig erected at the ground surface over the wellbore (or, in offshore drilling operations, on a seabed-supported drilling platform or a suitably adapted floating vessel).

During the drilling process, a drilling fluid (also commonly referred to in the industry as "drilling mud", or simply "mud") is pumped under pressure downward from the surface through the drill string, out the drill bit into the wellbore, and then upward back to the surface through the annular space between the drill string and the wellbore. The drilling fluid, which may be water-based or oil-based, is typically viscous to enhance its ability to carry wellbore cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the wellbore wall (to stabilize and seal the wellbore wall). To optimize these functions, it is desirable for as much of the drilling fluid as possible to reach the drill bit.

Particularly since the mid-1980s, it has become increasingly common and desirable in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized drill string components and "bottomhole assemblies" (BHAs) are used to induce, monitor, and control deviations in the path of the drill bit, so as to produce a wellbore of desired non-vertical configuration.

Directional drilling is typically carried out using a "downhole motor" (alternatively referred to as a "mud motor") incorporated into the drill string immediately above the drill bit. A typical mud motor includes several primary components, as follows (in order, starting from the top of the motor assembly):

- a top sub adapted to facilitate connection to the lower end of a drill string ("sub" being the common general term in the oil and gas industry for any small or secondary drill string component);
- a power section comprising a positive displacement motor of well-known type, with a helically-vaned rotor eccentrically rotatable within a stator section;
- a drive shaft enclosed within a drive shaft housing, with the upper end of the drive shaft being operably connected to the rotor of the power section; and
- a bearing section comprising a cylindrical mandrel coaxially and rotatably disposed within a cylindrical housing; with an upper end coupled to the lower end of the drive shaft; and a lower end adapted for connection to a drill bit. Typically, the coupling to the drive shaft is accomplished by providing the upper end of the mandrel with a threaded "pin" connection that threads into the mating "box" connection of an adapter associated with the lower end of the drive shaft assembly.

In drilling processes using a mud motor, drilling fluid is circulated under pressure through the drill string and back up to the surface as in conventional drilling methods. However, the pressurized drilling fluid exiting the lower end of the drill pipe is diverted through the power section of the mud motor to generate power to rotate the drill bit.

The bearing section must permit relative rotation between the mandrel and the housing, while also transferring axial thrust loads between the mandrel and the housing. Axial thrust loads arise in two drilling operational modes: "on-bottom" loading, and "off-bottom" loading. On-bottom loading corresponds to the operational mode during which the drill bit is boring into a subsurface formation under vertical load from the weight of the drill string, which in turn is in compression; in other words, the drill bit is on the bottom of the wellbore. Off-bottom loading corresponds to operational modes during which the drill bit is raised off the bottom of the wellbore and the drill string is in tension (i.e., when the bit is off the bottom of the wellbore and is hanging from the drill string, such as when the drill string is being "tripped" out of the wellbore, or when the wellbore is being reamed in the uphole direction). Tension loads across the bearing section housing and mandrel are also induced when circulating drilling fluid with the drill bit off bottom, due to the pressure drop across the drill bit and bearing assembly.

Accordingly, the bearing section of a mud motor must be capable of withstanding thrust loads in both axial directions, with the mandrel rotating inside the housing. A mud motor bearing section may be configured with one or more bearings that resist on-bottom thrust loads only, and with another one or more bearings that resist off-bottom thrust loads only. Alternatively, one or more bi-directional thrust bearings may be used to resist both on-bottom and off-bottom loads. A typical thrust bearing assembly comprises bearings (commonly but not necessarily roller bearings contained within a bearing cage) disposed within an annular bearing containment chamber. Suitable radial bearings (e.g., journal bearings or bushings) are used to maintain coaxial alignment between the mandrel and the bearing housing.

Thrust bearings contained in the bearing section of a mud motor may be either oil-lubricated or mud-lubricated. In an oil-sealed bearing assembly, the thrust bearings are disposed within an oil-filled reservoir to provide a clean operating environment. The oil reservoir is located within an annular region between the mandrel and the housing, with the reservoir being defined by the inner surface of the housing and the outer surface of the mandrel, and by sealing elements at the upper and lower ends of the reservoir.

Mud-lubricated bearing assemblies comprise bearings that are designed for operation in drilling fluid ("mud"). A small portion of the drilling fluid flowing to the drill bit is diverted to flow through the bearings to provide lubrication and cooling.

Oil-sealed bearing assemblies offer several advantages over mud-lubricated bearing assemblies. Because of the clean operating environment, oil-sealed components tend to have a much longer service life. Since conventional mud-lubricated bearing assemblies require a portion of the drilling fluid to be diverted through the bearings and to the wellbore annulus, the total flow of fluid through the drill bit is reduced, thereby reducing the effectiveness of the drilling fluid hydraulics through the bit. Oil-sealed assemblies do not require drilling fluid to be diverted and can be configured such that all the drilling fluid is directed through the bit, thus optimizing drilling fluid hydraulics through the bit. This can be particularly advantageous when running additional drilling tools between the mud motor and the drill bit, such as a rotary steerable system, where full flow of drilling fluid to the tool is required for optimum operation.

However, mud-lubricated bearings have their own advantages. In particular, mud-lubricated bearings with planar bearing contact surfaces can provide static thrust load capacities considerably greater than is achievable with conventional rolling-element bearings. In addition, mud-lubricated bearings can operate reliably in harsh environments, without need for a sealed bearing chamber.

As previously noted, separate thrust bearings may be used for on-bottom and off-bottom thrust loads, or bi-directional thrust bearings may be used to resist both on-bottom and off-bottom thrust loads. In either case, the mandrel must incorporate a load-transferring shoulder situated above the off-bottom bearing, for transferring off-bottom loads from the mandrel to the housing. This is commonly accomplished in prior art bearing assemblies through the use of a ring machined with an array of high-tolerance annular grooves and ribs sized to mate with corresponding high-tolerance annular ribs and grooves on the mandrel. The ring is necessarily provided in the form of a split ring to allow assembly onto the mandrel. When assembled on the mandrel, the split ring provides the necessary shoulder for off-bottom loads, which are transferred from the off-bottom thrust bearing (or, alternatively, a bi-directional thrust bearing) to the mandrel through the mating annular grooves and ribs of the mandrel and split ring. The spacing of the grooves and ribs in the mandrel and the split ring must be very precise so that axial load is shared equally between each adjacent set of mating groove/rib faces.

A rolling-element bearing (i.e., a bearing incorporating any type of rolling element, such as balls, cylindrical rollers, tapered rollers, and spherical rollers) will have static and dynamic load ratings that define allowable load limits during operation. An off-bottom thrust bearing can experience high static loads if the drill bit becomes stuck in the wellbore and the drill string needs to be put in tension in an attempt to pull the bit free. If the static load limit of the off-bottom bearing is exceeded, the motor will not be operable once the bit is pulled free, and the motor will need to be removed from the wellbore and replaced before drilling can continue.

For at least the reasons discussed above, there remains a need in the art for an oil-sealed mud motor bearing section in which the mandrel is provided with a load-transferring shoulder for reacting off-bottom thrust loads, but without the need for high-tolerance machining of the mandrel and associated shoulder components. Further, there remains a need in the art for a mud motor bearing section incorporating an off-bottom thrust bearing having a static load limit much greater than provided by rolling-element bearings. Still further, there remains a need in the art for a mud motor bearing section incorporating a mud-lubricated off-bottom bearing assembly in which the mud flow through the off-bottom bearing assembly is returned to the main mud flow through the bearing section, rather than exiting into the wellbore annulus and thereby reducing the total mud flow reaching the drill bit. Embodiments disclosed herein are directed to such needs.

BRIEF SUMMARY OF THE DISCLOSURE

Embodiments described herein generally teach mud motor bearing assemblies having an oil-sealed bearing chamber which houses at least one oil-sealed thrust bearing for resisting on-bottom thrust loads, with off-bottom thrust loads being resisted by a mud-lubricated thrust bearing disposed within an off-bottom thrust bearing chamber located above the oil-sealed bearing chamber. Radial loads acting on the bearing assemblies are resisted by radial bearings located within the oil-sealed chamber. Being oil-sealed, the radial bearings and the on-bottom thrust bearing are in an optimum operating environment, and there is no need to divert any drilling mud through the on-bottom thrust bearing chamber. Drilling mud used to lubricate and cool the off-bottom thrust bearing rejoins the flow of mud to the drill bit rather than being discharged into the wellbore annulus.

In accordance with embodiments described herein, the lower end of a drive shaft adapter connected to the mandrel effectively serves, either directly or through intermediary structure, as the load-transferring shoulder required in association with the mandrel for transfer of off-bottom thrust loads. This eliminates the need for an intermediate support shoulder along the mandrel such as the split ring shoulder used in prior art assemblies, thus eliminating the need for the high-tolerance machining entailed by such split ring shoulders. In addition, utilization of the drive shaft adapter for transfer of off-bottom thrust loads shortens the overall length of the bearing assembly. Furthermore, by eliminating the use of a rolling-element bearing for off-bottom thrust loads, the static load limit of the off-bottom thrust bearing assembly is significantly increased, such that when the drill string is being pulled to free a stuck drill bit, there is little or no risk of overloading the off-bottom thrust bearing and thus making the mud motor inoperable after the bit has been pulled free.

Accordingly, embodiments described herein teach a bearing section for a mud motor, comprising: an elongate mandrel rotatably and coaxially disposed within an elongate cylindrical housing; a first (or upper) annular bearing chamber laterally bounded by the outer surface of the mandrel, the inner surface of the housing, an annular abutment associated with the housing, and the lower end of a cylindrical drive shaft adapter mounted to the upper end of the mandrel; and a mud-lubricated thrust bearing assembly disposed within the first bearing chamber such that the mud-lubricated thrust bearing assembly will be in compression between the annular abutment and the drive shaft adapter when the bearing section is in tension, thereby resisting off-bottom thrust loads. The mandrel is generally cylindrical, with a central bore for passage of drilling mud, and a generally cylindrical wall. One or more mud ports are formed through the mandrel wall such that drilling mud flowing through the first bearing chamber to lubricate and cool the thrust bearing assembly will exit the bearing chamber through the one or more mud ports, joining the main flow of drilling mud through the central bore of the mandrel and downward to the drill bit.

In alternative embodiments, the bearing section also incorporates an annular oil reservoir bounded by the outer surface of the mandrel, the inner surface of the housing, and upper and lower rotary seals between the mandrel and the housing. A portion of the oil reservoir defines a second (or lower) annular bearing chamber, bounded at its lower end by an annular lower shoulder associated with the mandrel, and at its upper end by an annular upper shoulder associated with the housing. A thrust bearing is disposed within the second bearing chamber such that it will be in compression between the upper and lower shoulders when the bearing section is in compression, thereby resisting on-bottom thrust loads.

In some embodiments, the bearing section further incorporates a mud-lubricated radial bearing assembly disposed within the first (or upper) bearing chamber.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
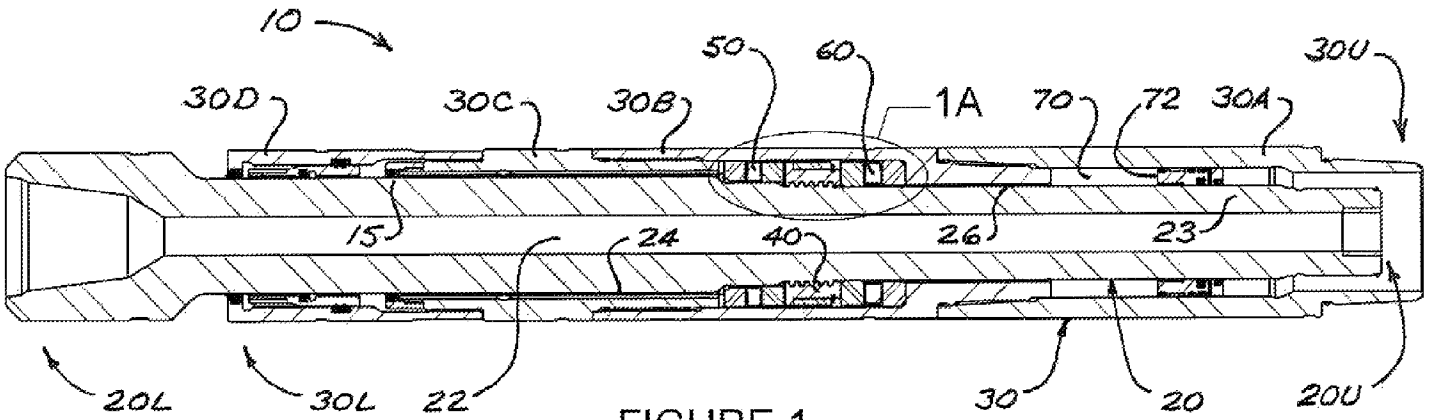
FIGURE 1 (PRIOR ART)
FIG. 1 is a longitudinal cross-section through the bearing section of a prior art mud motor, showing on-bottom and off-bottom thrust bearings with associated split-ring load-transferring shoulders.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 1A:
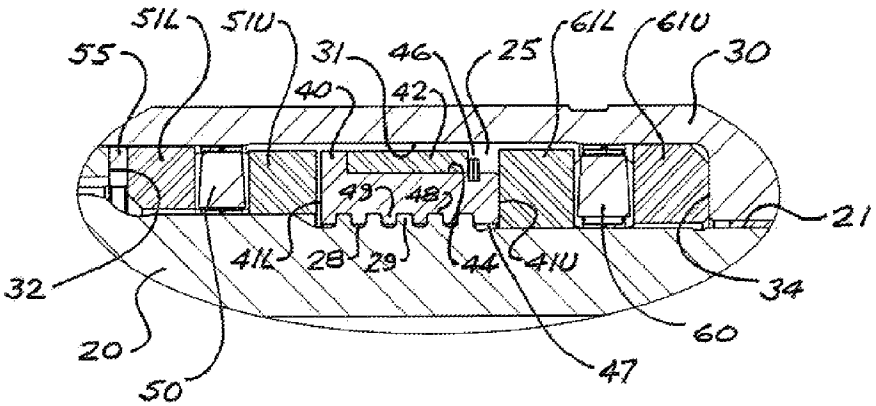
FIGURE 1A (PRIOR ART)
FIG. 1A is an enlarged view of the bearing chamber of the prior art bearing section of FIG. 1, with the bearing section operating under on-bottom thrust loading.

FIGS. 1 and 1A illustrate a typical oil-sealed bearing assembly in the bearing section 10 of a conventional mud motor. Bearing section 10 includes a mandrel 20 having an upper end 20U, a lower end 20L, and a generally cylindrical mandrel wall 23 defining a central bore 22 through which drilling fluid can be pumped down to a drill bit (not shown) connected directly or indirectly to lower end 20L of mandrel 20. Mandrel 20 is coaxially and rotatably disposed within a cylindrical housing 30, which typically will be made up of multiple subsections (such as 30A, 30B, 30C, 30D in FIG. 1) threaded together. Housing 30 has an upper end 30U adapted for connection to the lower end of the drive shaft housing (not shown) of the mud motor, and a lower end 30L (through which lower end 20L of mandrel 20 projects). Upper end 20U of mandrel 20 is adapted for connection to the drive shaft (not shown) of the mud motor, such that the drive shaft will rotate mandrel 20 within and relative to housing 30.

As best shown in FIG. 1A, an annular bearing chamber 25 is formed between mandrel 20 and housing 30, in a medial region of bearing section 10. A portion of outer surface 21 of mandrel 20 within bearing chamber 25 is machined to form a group of annular grooves 28 and ribs 29 that engage a split ring 40, which has a lower annular shoulder 41L, an upper annular shoulder 41U, and an inner cylindrical surface 47. The inner cylindrical surface 47 of split ring 40 is machined to form a group of annular ribs 49 and grooves 48 which mate in a close-tolerance fit with annular grooves 28 and ribs 29 of mandrel 20. Annular grooves 28 and 48 and annular ribs 29 and 49 must be machined with great precision for uniform transfer of axial thrust loads between mandrel 20 and split ring 40. Split ring 40 is kept in place radially on mandrel 20 by means of a retainer ring 42 positioned in an annular recess 44 in split ring 40 and held in place axially by a snap ring 46.

An oil-lubricated lower thrust bearing 50, with lower bearing race 51L and upper bearing race 51U, is disposed within bearing chamber 25 below and immediately adjacent to lower shoulder 41L of split ring 40. Shims 55 may be provided as shown in association to facilitate positioning of bearing 50 within bearing chamber 25. Off-bottom (tensile) thrust loads are transferred from mandrel 20 to split ring 40 (via annular grooves 28 and 48 and annular ribs 29 and 49); thence via lower shoulder 41L of split ring 40 to upper bearing race 51U, lower thrust bearing 50, and lower bearing race 51L; and thence to a lower shoulder 32 formed in housing 30.

An oil-lubricated upper thrust bearing 60, with lower bearing race 61L and upper bearing race 61U, is disposed within bearing chamber 25 above and immediately adjacent to upper shoulder 41U of split ring 40. As best shown in FIG. 1A, on-bottom (compressive) thrust loads are transferred from mandrel 20 to split ring 40 (via annular grooves 28 and 48 and annular ribs 29 and 49); thence via upper shoulder 41U of split ring 40 to lower bearing race 61L, upper thrust bearing 60, and upper bearing race 61U; and thence to an upper shoulder 34 formed in housing 30.

Accordingly, bearing chamber 25 of conventional bearing section 10 is defined by outer surface 21 of mandrel 20, inner surface 31 of housing 30, lower shoulder 32 in housing 30, and upper shoulder 34 in housing 30. Between bearing chamber 25 and lower end 30L of housing 30, a lower radial bearing (shown in the form of a lower bushing 24) is provided below bearing chamber 25 in an annular space between mandrel 20 and housing 30, to provide radial support to mandrel 20 as it rotates within housing 30. Similarly, an upper radial bearing (shown in the form of an upper bushing 26) is provided above bearing chamber 25 in an annular space between mandrel 20 and housing 30.

Bearing section 10 in FIG. 1 also includes an annularly-configured piston 72 disposed and axially movable within a cylindrical chamber 70 located in a region above bearing chamber 25. Piston 72 forms part of a pressure compensation system whereby the position of piston 72 automatically adjusts to compensate for changes in oil volume due to temperature changes and gradual oil leakage associated with the rotary seals. Bearing chamber 25 and cylindrical chamber 70 are contained within an annular oil reservoir sealed at its lower end by a lower rotary seal 15 and at its upper end by seals associated with piston 72.

Figure 2:
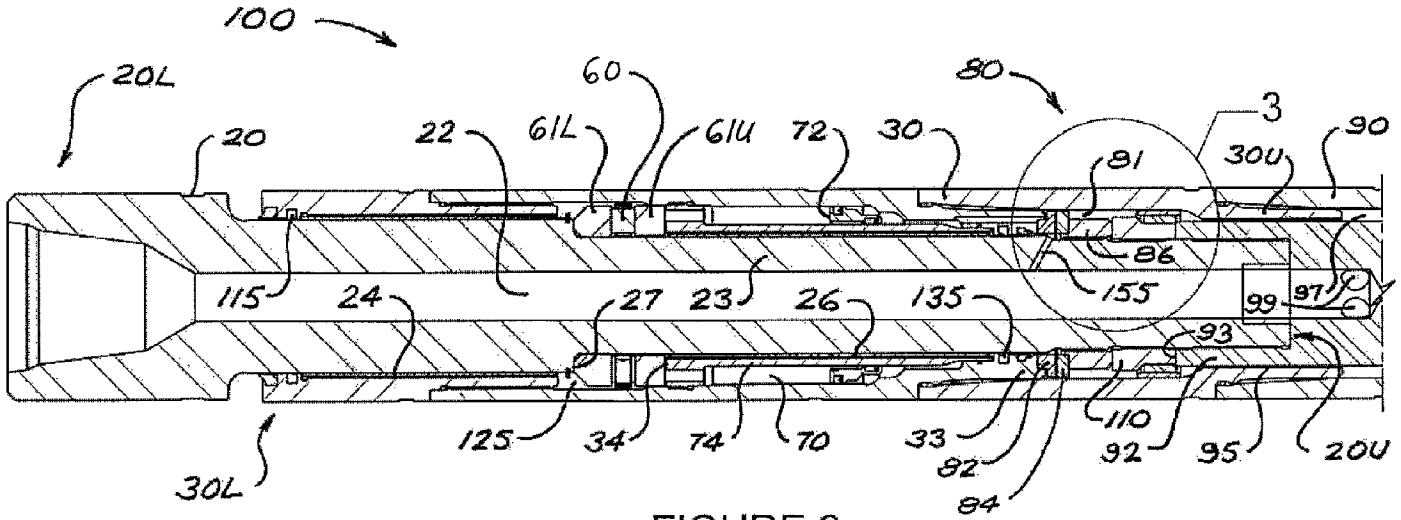
FIG. 2 is a longitudinal cross-section through the bearing section of an embodiment of a mud motor incorporating an off-bottom thrust bearing assembly in accordance with the principles described herein.

Referring now to FIG. 2, an embodiment of a mud motor bearing section 100 incorporating an oil-sealed on-bottom thrust bearing and a mud-lubricated off-bottom thrust bearing in accordance with the principles described herein is shown. Bearing section 100 includes mandrel 20 and housing 30 generally as described and illustrated with reference to bearing section 10 of FIG. 1. In FIG. 2, bearing section 100 is shown incorporating an alternative pressure compensation system different from the system shown in FIG. 1, with piston 72 disposed within a cylindrical chamber 70 formed by a sleeve 74 non-rotatably mounted to housing 30. This alternative pressure compensation system is described in U.S. patent application Ser. No. 12/985,703 filed on Jan. 6, 2011 and entitled, "Pressure Compensation System For An Oil-Sealed Mud Motor Bearing Assembly," which is incorporated herein by reference in its entirety. Embodiments of off-bottom thrust bearing assemblies in accordance with the principles described herein are particularly well adapted for use in conjunction with such alternative pressure compensation systems. However, it is to be understood that embodiments described herein are independent of and are not in any way limited or restricted by any pressure compensation system incorporated into the mud motor bearing section incorporating bearing assemblies.

As shown in FIG. 2, bearing section 100 incorporates an oil-sealed on-bottom thrust bearing 60, with lower bearing race 61L and upper bearing race 61U, disposed within an annular lower bearing chamber 125 between mandrel 20 and housing 30. On-bottom (compressive) thrust loads are transferred from mandrel 20 to lower bearing race 61L via an annular lower load-transfer shoulder 27 formed on mandrel 20, and thence into housing 30 through thrust bearing 60, upper bearing race 61U, and an annular upper load-transfer shoulder 34 associated with housing 30 (for example, in the embodiment shown in FIG. 2, the lower end of sleeve 74 serves as shoulder 34). Accordingly, lower bearing chamber 125 of bearing section 100 is defined by outer surface 21 of mandrel 20, inner surface 31 of housing 30, shoulder 27 on mandrel 20, and shoulder 34 on housing 30.

A lower radial bushing 24 is provided below lower bearing chamber 125 in an annular space between mandrel 20 and housing 30 to provide radial support to mandrel 20 as it rotates within housing 30. Similarly, an upper radial bushing 26 is provided above lower bearing chamber 125. Lower bearing chamber 125 and cylindrical chamber 70 are contained within an annular oil reservoir sealed at its lower end by a lower rotary seal 115 between mandrel 20 and housing 30, and at its upper end by an upper rotary seal 135 between mandrel 20 and housing 30.

As shown in FIG. 2, the lower end of a cylindrical drive shaft housing 90 is threaded onto upper end 30U of housing 30, and the lower end of a drive shaft adapter 92 disposed within drive shaft housing 90 is threaded onto upper end 20U of mandrel 20 (as indicated by threaded connection 91). The cylindrical lower end of drive shaft adapter 92 defines an annular abutment 93 encircling upper end 20U of mandrel 20. A drive shaft housing annulus 97 is formed between drive shaft housing 90 and drive shaft adapter 92. Drive shaft adapter 92 is formed with mud flow channels 99 through which drilling mud can flow from drive shaft housing annulus 97 into central bore 22 of mandrel 20.

Figure 3B:
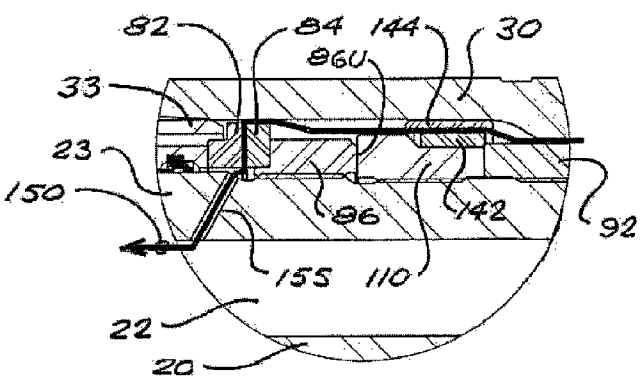
FIG. 3B is an enlarged view of the off-bottom thrust bearing assembly of FIG. 2, indicating the flow path for drilling fluid through the off-bottom thrust bearing assembly.
Figure 3A:
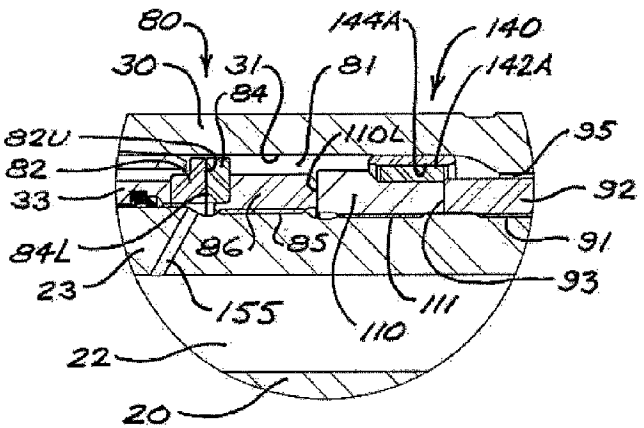
FIG. 3A is an enlarged view of the off-bottom thrust bearing assembly of FIG. 2, as configured when the bearing section is operating under off-bottom thrust loading conditions.

FIGS. 3A and 3B illustrate an embodiment of a mud-lubricated off-bottom thrust bearing assembly 80 in accordance with the principles described herein, and also incorporating an optional radial bearing assembly 140 (described in further detail below). Off-bottom thrust bearing assembly 80 is disposed within an annular upper bearing chamber 81 between mandrel 20 and housing 30. A lower load-transfer-ring shoulder associated with housing 30 is provided in the form of an annular lower thrust bearing race 82 mounted to the upper end of an annular abutment 33 forming part of housing 30, using suitable mounting means (such as, by way of non-limiting example, press-fitting or shrink-fitting bearing race 82 into housing 30, or by using anti-rotation dowel pins between bearing race 82 and housing 30) whereby relative rotation between lower thrust bearing race 82 and housing 30 is prevented. Lower thrust bearing race 82 has a planar upper face 82U transverse to the axis of mandrel 20, and is preferably formed from, or has its upper face 82U hard-faced with, a highly-polished and wear-resistant material such as tungsten carbide or cemented carbide. An annular upper thrust bearing race 84 having a planar lower face 84L is mounted, by similar non-rotatable means as previously described for lower bearing race 82, to the lower end of an internally-threaded ring 86, which has a planar annular upper surface 86U and is threaded onto mandrel 20 (as indicated by threaded connection 85). Lower face 84L of upper thrust bearing race 84 is preferably hard-faced like upper face 82U of lower bearing race 82, previously described.

FIGS. 3A and 3B also illustrate optional radial bearing assembly 140 provided in conjunction with off-bottom thrust bearing assembly 80. An internally-threaded radial bearing support ring 110 having planar annular upper and lower surfaces 110U and 110L is threaded coaxially onto mandrel 20 (as indicated by threaded connection 111) above threaded ring 86, with lower surface 110L abutting upper surface 86U of threaded ring 86, and with upper surface 110U abutting annular abutment 93 of drive shaft adapter 92. In the illustrated embodiment, radial bearing assembly 140 comprises an inner radial bearing race 142 coaxially and non-rotatably mounted on support ring 110, and an outer radial bearing race 144 coaxially and non-rotatably mounted within housing 30. As best seen in FIG. 3A, inner radial bearing race 142 has a cylindrical contact surface 142A and outer radial bearing race 144 has a cylindrical contact surface 144A. Contact surfaces 142A and 144A rotate relative to each other, and in mating contact, as mandrel 20 rotates relative to housing 30.

Radial bearing races 142 and 144 may be formed from, or may have their respective contact surfaces 142A and 144A hard-faced with, a highly-polished and wear-resistant material such as tungsten carbide or cemented carbide. Optionally, either or both of contact surfaces 142A and 144A may be provided with flow channels (not shown) to facilitate the flow of lubricating mud over the interface between contact surfaces 142A and 144A. Although optional and not essential to the broadest embodiments described herein, radial bearing assembly 140 is advantageous to provide additional radial support to upper end 20U of mandrel 20 as it rotates within housing 30.

The operation of bearing section 100 may be readily understood with reference to the Figures and to the foregoing description. In addition to being rotatable relative to housing 30, mandrel 20 can also move axially relative to housing 30 over a short range of travel determined by the dimensions and positions of various components of the on-bottom and off-bottom thrust bearing assemblies. More specifically, when bearing section 100 is under on-bottom loading, such as when the drill bit is under load on the bottom of a wellbore, mandrel 20 is shifted slightly upward into housing 30 such that on-bottom thrust bearing 60 and its associated races 61U and 61L are in compression between load-transfer shoulder 27 of mandrel 20 and load-transfer shoulder 34 of housing 30. The compressive on-bottom thrust loads are thus transferred from mandrel 20 to housing 30 through thrust bearing 60.

This upward shift of mandrel 20 into housing 30 has the effect of shifting threaded ring 86 slightly upward relative to housing 30, thus opening a gap between lower face 84L of bearing race 84 and upper face 82U of bearing race 82. However, when compressive load on bearing section 100 is relieved (by lifting the drill bit off the bottom of the wellbore), bearing section 100 will then be under off-bottom (tensile) thrust loading, and gravity and/or fluid pressure will cause mandrel 20 to shift axially downward relative to housing 30, thereby bringing lower face 84L of bearing race 84 into tight mating contact with upper face 82U of bearing race 82, as seen in FIG. 3A. At the same time, the length of lower bearing chamber 125 (i.e., the distance between load-transfer shoulders 27 and 34) will increase slightly, thereby unloading thrust bearing 60. Off-bottom thrust loads are thus resisted by contact between surfaces 82U and 84L of bearing races 82 and 84 of off-bottom thrust bearing assembly 80.

During operation of the mud motor, drilling mud is pumped downward through drive shaft housing annulus 97 and then is directed into central bore 22 of mandrel 20 through mud flow channels 99 in drive shaft adapter 92. A small portion of the mud flow is diverted through off-bottom thrust bearing assembly 80 to provide lubrication and cooling for thrust bearing assembly 80 (and radial bearing assembly 140 when included) before rejoining the main flow of mud in central bore 22. This is illustrated more specifically in FIG. 3B, which shows a mud flow path 150 downward from drive shaft housing annulus 97 through an annular space 95 between drive shaft adapter 92 and bearing section housing 30; then through the interface between contact surfaces 142A and 144A of radial bearing races 142 and 144; then downward through upper bearing chamber 81 and through the radial interface between lower face 84L of upper thrust bearing race 84 and upper face 82U of lower bearing race 82; and finally through one or more mud ports 155 through mandrel wall 23 into central bore 22. In this way, substantially all of the drilling mud diverted through upper bearing chamber 81 to lubricate and cool bearing assembly 80 will rejoin the primary flow of drilling fluid through central bore 22 down to the drill bit.

In an unillustrated alternative embodiment, in which bearing race 84 is not fixed axially to threaded ring 86, fluid flow through the bearing assembly will keep faces 82U and 84L together, and a gap will open up between bearing race 84 and threaded ring 86, rather than between bearing race 84 and bearing race 82. However, the operation of the assembly will be otherwise as described above.

As previously noted, the radial bearing assembly 140 illustrated in FIGS. 2, 3A, and 3B is optional. In one alternative embodiment, the threaded ring 86 and radial bearing support ring 110 are combined to form a single part. In a second alternative embodiment, the components of off-bottom thrust bearing assembly 80 are essentially as described above and illustrated in FIGS. 2, 3A, and 3B, except that radial bearing support ring 110, inner radial bearing race 142, and outer radial bearing race 144 are eliminated. In this alternative embodiment, upper surface 86U of threaded ring 86 bears directly against annular abutment 93 of drive shaft adapter 92, but the operation of bearing section 100 under both on-bottom and off-bottom thrust loading is effectively the same as previously described herein. In yet a third alternative embodiment, threaded ring 86 is also eliminated, and upper thrust bearing race 84 is mounted to the lower end of drive shaft adapter 92.

Figure 3C:
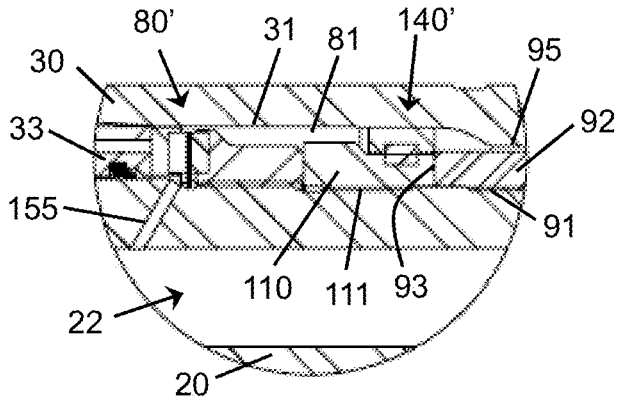
FIG. 3C is an enlarged cross-sectional view of an embodiment of a bearing section of a mud motor including a mud-lubricated off-bottom thrust bearing assembly in accordance with the principles described herein.

In the mud-lubricated off-bottom bearing assembly 80 shown in FIGS. 2, 3A, and 3B, the load-transferring surfaces (lower face 84L of bearing race 84 and upper face 82U of bearing race 82) are in direct contact when bearing section 100 is operating off-bottom, with lower face 84L rotating relative to upper face 82U. However, this is by way of example only, and other types of mud-lubricated bearing assemblies can be used without departing from the concept and scope of this disclosure. For example, FIG. 3C is an enlarged partial view of a bearing section of a mud motor that is substantially the same as bearing section 100 previously described except that mud-lubricated thrust bearing assembly 80 is replaced with a mud-lubricated thrust bearing assembly 80' comprising insert bearings and mud-lubricated radial bearing assembly 140 is replaced with a mud-lubricated radial bearing assembly 140' comprising insert bearings. In general, the insert bearings can be polycrystalline diamond compact (PDC) insert bearings of the type available from US Synthetic Bearings of Orem, Utah, or ceramic insert bearings of the type manufactured by Ceradyne, Inc. of Costa Mesa, Calif.

Figure 3D:
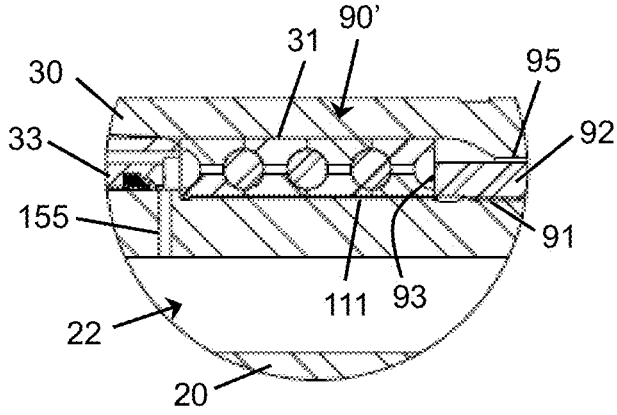
FIG. 3D is an enlarged cross-sectional view of an embodiment of a bearing section of a mud motor including a mud-lubricated off-bottom thrust bearing assembly in accordance with the principles described herein.

Another alternative embodiment would use mud-lubricated roller bearings and races. For example, FIG. 3D is an enlarged partial view of a bearing section of a mud motor that is substantially the same as bearing section 100 previously described except that mud-lubricated. thrust bearing assembly 80 and mud-lubricated radial bearing assembly 140 are replaced with a mud-lubricated bearing assembly 90' comprising roller bearings that support both thrust and radial loads. In general, the mud-lubricated roller bearings can be those available from QA Bearing Technologies Ltd. of Edmonton, Alberta and QA Bearing Technologies (USA) Inc. of Houston, Tex. Although not providing static load capacities as high as are available with other types of mud-lubricated bearings, these alternative bearings would nonetheless provide advantages over prior art bearing arrangements by virtue of not requiring a high-tolerance split ring to provide load-transferring shoulders (as in the prior art bearing section of FIG. 1).

In alternative embodiments, radial bearings 112 and 114 could be provided in the form of PDC insert bearings or ball bearings such as those shown in FIGS. 3C and 3D, respectively.

In alternative embodiments radial bearing assembly 140 could be located below mud-lubricated off-bottom thrust bearing assembly 80, rather than above it as in the embodiment shown in FIGS. 2, 3A, and 3B.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A bearing section for a mud motor, comprising:

an elongate mandrel rotatably and coaxially disposed within an elongate cylindrical housing; said mandrel having an upper end, a lower end, an outer surface extending from the upper end to the lower end, and a central bore extending from the upper end to the lower end;

an annular first bearing chamber radially disposed between the mandrel and the housing, the first bearing chamber having a lower end defined by an annular abutment associated with the housing and an upper end defined by a lower end of a cylindrical drive shaft adapter mounted to the upper end of the mandrel;

a mud-lubricated thrust bearing assembly disposed within said first bearing chamber axially adjacent the lower end of the first bearing chamber, wherein the mud-lubricated thrust bearing assembly is configured to support compressional loads between said annular abutment and said drive shaft adapter when the bearing section is under axial tension;

an annular space disposed between the drive shaft adapter and the housing, wherein the annular space is in fluid communication with the first bearing chamber and is configured to flow drilling fluid into the first bearing chamber;

one or more ports extending through the mandrel from the first bearing chamber to the central bore, wherein the one or more ports are configured to flow drilling fluid from the first bearing chamber into the central bore;

an annular oil reservoir radially disposed between the mandrel and the housing, and extending axially between an upper rotary seal positioned between the mandrel and the housing and a lower rotary seal positioned between the mandrel and the housing, a portion of said oil reservoir defining an annular second bearing chamber, wherein said second bearing chamber has a lower end bounded by an annular lower shoulder associated with the mandrel and an upper end bounded by an annular upper shoulder associated with the housing; and a thrust bearing disposed within said second bearing chamber, wherein said thrust bearing is configured to support compressional loads between said upper and lower shoulders when the bearing section is under axial compression.

2. The bearing section of claim 1, wherein the mud-lubricated thrust bearing assembly comprises:

an upper bearing race non-rotatably mounted to the lower end of the drive shaft adapter; and a lower bearing race non-rotatably mounted to the annular abutment associated with the housing.

3. The bearing section of claim 2, wherein:

the upper bearing race has a planar lower face transverse to the axis of the mandrel; and the lower bearing race has a planar upper face transverse to the axis of the mandrel, said upper face being matingly engageable with said lower face of the upper bearing race.

4. The bearing section of claim 3, wherein the lower face of the upper bearing race and the upper face of the lower bearing race are hard-faced with a wear-resistant material.

5. The bearing section of claim 4, wherein the wear-resistant material comprises cemented carbide.

6. The bearing section of claim 1, wherein the mud-lubricated thrust bearing assembly comprises polycrystalline diamond compact insert bearings.

7. The bearing section of claim 1, wherein the mud-lubricated thrust bearing assembly comprises ceramic insert bearings.

8. The bearing section of claim 1, wherein the mud-lubricated thrust bearing assembly comprises roller bearings.

9. The bearing section of claim 1, further comprising a radial bearing assembly disposed within the first bearing chamber.

10. The bearing section of claim 9, wherein the radial bearing assembly comprises:

a radial bearing support ring disposed coaxially around the mandrel;

a cylindrical inner radial bearing race having an outer cylindrical contact surface, said inner radial bearing race being disposed coaxially around the radial bearing support ring and non-rotatably mounted thereto;

a cylindrical outer radial bearing race having an inner cylindrical contact surface, said outer radial bearing race being non-rotatably mounted to the housing with said inner cylindrical contact surface in mating engagement with the outer cylindrical contact surface of the inner radial bearing race.

11. The bearing section of claim 9, wherein the radial bearing assembly comprises polycrystalline diamond compact insert bearings.

12. The bearing section of claim 9, wherein the radial bearing assembly comprises ball bearings.

* * * * *